US005234220A

United States Patent [19]

Schellhammer et al.

[11] Patent Number: 5,234,220

[45] Date of Patent: Aug. 10, 1993

[54] ARCHERY ARROWS

[75] Inventors: David A. Schellhammer, Wykoff, Minn.; Frank J. Pearson, Tucson, Ariz.

[73] Assignee: Morrison Molded Fiber Glass Company, Bristol, Va.

[21] Appl. No.: 851,031

[22] Filed: Mar. 9, 1992

[51] Int. Cl.[5] ..... F42B 6/04

[52] U.S. Cl. ..... 273/416; 273/421; 273/80 B; 156/180; 156/277

[58] Field of Search ..... 273/416, 419, 420, 421, 273/77 A, 80 B; 156/180, 277

[56] References Cited

U.S. PATENT DOCUMENTS

| | | | |
|---|---|---|---|
| 2,694,661 | 11/1954 | Meyer | 273/416 X |
| 3,470,051 | 9/1969 | Meyer | 156/180 X |
| 4,133,427 | 1/1979 | Loomis | 273/416 X |
| 4,154,634 | 5/1979 | Shobert et al. | 156/180 |
| 4,563,007 | 1/1986 | Bayliss et al. . | |
| 4,706,965 | 11/1987 | Schaar . | |
| 4,874,180 | 10/1989 | Fingerson et al. . | |
| 4,944,520 | 7/1990 | Fingerson et al. . | |
| 4,958,834 | 9/1990 | Colbert | 273/80 B X |
| 5,040,279 | 8/1991 | Braly | 273/77 A X |
| 5,092,950 | 3/1992 | Spoo et al. | 156/180 |

FOREIGN PATENT DOCUMENTS 1172666 12/1969 United Kingdom .

OTHER PUBLICATIONS

Archer's Bible 1966–67 pp. 50–53 & 56–57 Mar. 1967.

*Primary Examiner*—Paul E. Shapiro
*Attorney, Agent, or Firm*—Wayne Hoover

[57] ABSTRACT

Arrows comprising a shaft having its original orientation through the die in which it was prepared marked or otherwise indicated. Any suitable marking or other indication can be used. The arrows may be pre-grouped and bundled. The shaft may be prepared with any suitable process including extrusion and pultrusion.

18 Claims, 2 Drawing Sheets

ARCHERY ARROWS

BACKGROUND OF THE INVENTION

1. Field of the Invention

This invention relates to archery arrows. More particularly, this invention relates to arrows, arrow shafts, sets of pre-grouped archery arrows, and to a method for preparing the arrow shafts.

2. Prior Art

A principal problem associated with the use of archery arrows, particularly professionally, is the grouping; i.e., the selection of a group of arrows which will hit the target at the same or substantially the same place when fired from a bow in essentially the same manner. Heretofore, grouping has been a long, drawn-out, tedious effort generally accomplished on a trial and error basis. Even with this effort, however, it is generally difficult to find a group of even twelve arrows which will hit the target in substantially the same place. In light of this difficulty, the need for arrow shafts which lend themselves to the production of pre-grouped arrows, arrows which may be pre-grouped, pre-grouped archery arrows and a process for making such shafts is believed to be readily apparent.

SUMMARY OF THE INVENTION

It has now been discovered that the foregoing and other disadvantages of the prior art grouping technology can be avoided, or at least significantly reduced, with the grouping technique of this invention. It is, therefore, an object of this invention to provide a shaft which may be used to produce pre-grouped arrows. It is another object of this invention to provide arrows which may be pre-grouped. It is still another object of this invention to provide pre-grouped archery arrows. It is yet another object of this invention to provide a method for preparing shafts which may be used to produce pre-grouped arrows.

In accordance with the present invention, the foregoing and other objects and advantages are accomplished by marking or otherwise indicating the orientation of the shafts as they come through the die and binding sets of arrows having the same or substantially the same orientation in groups which are prepared from the same batch of raw material. The batching can, then, be viewed as a time element since arrows prepared with the same batch of raw materials will pass through the dies at close to the same time. The marking or other indication on the arrow will not only mark the orientation of the arrow but it will also identify the die that the arrow was prepared with. The time or composition of raw material will be controlled primarily by grouping of the arrows although as indicated infra other means might be used.

SUMMARY OF THE INVENTION

As indicated supra, the present invention is drawn to shafts which may be used to prepare pre-grouped arrows, arrows which may be pre-grouped, pre-grouped sets of arrows and a method for preparing shafts which may be used in the production of pre-grouped arrows. The arrows may be pre-grouped by marking or otherwise indicating the orientation of the arrow through the die with which it was made and by bundling the sets so as to incorporated arrows which were made at close to the same time with the same raw material composition.

As indicated supra, grouping has long been a problem in the use of archery arrows. Recently, it has been discovered that a major factor in grouping of arrows is the orientation at which the arrow passed through the die. Another factor affecting grouping is the composition of the arrow. As also indicated supra, the composition is, in effect, a time element since arrows passing through the die at nearly the same time will be prepared with the same raw material composition.

The arrow shaft of the arrow of this invention will be made with graphite or carbon fibers, glass or similar unidirectional reinforcing fibers. The arrow shaft will, preferably, be prepared by pultrusion of the raw material through the die, although as a practical matter, if the raw material lends itself to an extrusion operation, the arrow shaft could be extruded. When thread or string is used to mark the orientation of the arrow shaft through the die, the thread or string will be passed continuously through the die such that it adheres to the surface of the arrow shaft. The orientation could, however, be accomplished by marking the arrow shaft with any type of mark or indicia such as circles, squares, arrows, and the like as well as a combination of letters or numbers as well as painted lines. When markings of this latter type are used, they will, generally, be affixed to the arrow shaft immediately upon its departure from the die. Any suitable manner of affixing the mark or indicia to the arrow shaft could be used. The same marking will, of course, be used with the same die at least as long as the composition of the raw material used to prepare the arrow shaft is the same. The mark or indicia could, however, be used continuously; i.e., at all times simply to identify the die through which the arrow shaft was passed and to identify the orientation thereof. The time at which the arrow shaft was manufactured would, then, be controlled solely by bundling. Varying the mark or indicia with raw material composition is, however, within the scope of the present invention.

DETAILED DESCRIPTION OF THE INVENTION

As indicated supra, the present invention relates to an arrow shaft which may be used to prepare pre-grouped arrows, arrows which may be pre-grouped, pre-grouped sets of arrows and a method of preparing shafts which may be used in the production of pregrouped arrows, the orientation of which shafts, through the die, is marked or otherwise indicated by suitable means so as to allow consistent manufacture of the arrows therewith. In general, any suitable marking or indicia may be used. For example, the relative rotation of the arrow shaft could be marked or indicated with a thread or string which is pultruded simultaneously with the arrow in such a manner that at least a portion thereof is visible from the surface. The marking may also be accomplished with suitable dots buried in the arrow structure or painted thereon or with similar geometric structures. The shaft may also be marked simply by painting a line thereon or by using one or more numbers or letters which would, generally, be painted thereon. The marking or other indication in any case would be affixed so as to mark the original orientation of the shaft through the die. The marking of the original orientation through the die could then be used to allow consistent fixing of the arrowhead and the nock to the arrow shaft. This, then, would produce shafts which group well and would hit a target at least substantially the same place at least when the shafts were produced from the same relative raw material composition.

Figure 1:
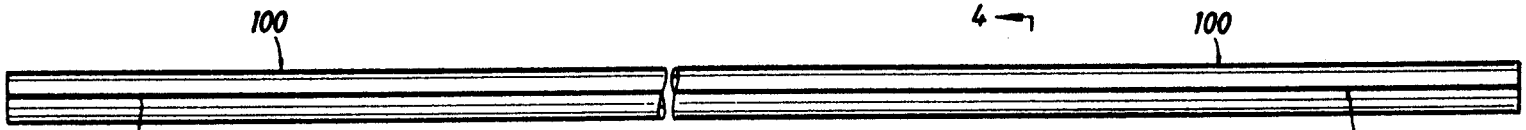
FIG. 1 is an elevational side view illustrating an arrow shaft marked with a string or thread in accordance with this invention.
Figure 4:
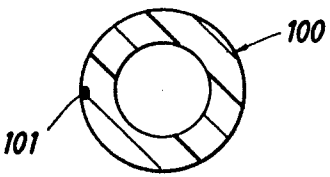
FIG. 4 is an axial cross section of the shaft shown in FIG. 1 taken along line 4—4.

Referring to the drawings, where like numerals apply to like parts, and more particularly to FIG. 1, there is shown an arrow shaft 100—100 having the original orientation through the die marked with a string or thread 101—101. The location of the string or thread in the arrow shaft will, consistently, identify the original orientation through the die and, as indicated supra, will facilitate mounting the nock on the shaft consistently when needed for assembly of the arrow. The color of the string or thread will identify the actual die that the shaft passed through and, while not essential, could also reflect the composition of the raw materials used to prepare the shaft. In this regard, it should again be noted that the arrow shaft can be prepared with carbon, glass or similar unidirectional reinforcing fibers and when the color of the string or thread is used to identify a consistent composition the color would be changed each time the composition of raw material is changed. How the thread or string 101 is positioned at the surface of the shaft 100 is illustrated in FIG. 4.

Figure 2:
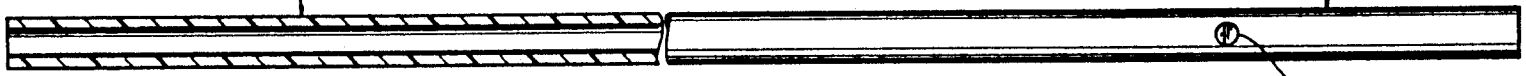
FIG. 2 is a partially sectioned side view of an arrow shaft marked with a dot and within the scope of the present invention.
Figure 5:
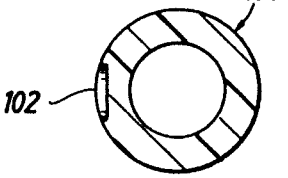
FIG. 5 is an axial cross section of the arrow shaft shown in FIG. 2 taken along line 5—5.

Referring now to FIG. 2, there is, in this Figure, illustrated another way of marking or otherwise indicating the original orientation of the arrow shaft through the die. In the embodiment illustrated, a colored circle 102 introduced into the arrow shaft as it goes through the die such that the surface thereof is flush with the surface of the arrow shaft is used. Obviously, the shape of the marker is not critical and essentially any geometrical shape could be used to accomplish the desired marking. Also, while a structural circle which may be prepared of any suitable material has been illustrated, the geometric structures could, indeed, be painted onto the arrow shaft after the shaft passes through the die. As also illustrated in FIG. 2, the arrow shaft may be hollow and contain a bore 103. The insertion of the circle into the arrow shaft is illustrated in FIG. 5. As there illustrated, the surface of the circle 102 is flush with the surface of the arrow shaft 100.

Figure 3:
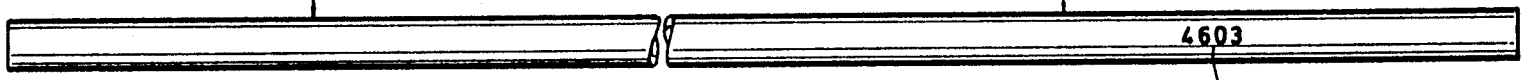
FIG. 3 is an elevational side view of an arrow shaft marked with still other suitable means within the scope of this invention.

In FIG. 3, still another way of marking or otherwise indicating the original orientation of the arrow shaft 100 relative to the die is shown. In the embodiment illustrated, the marking or indication is accomplished with a series of numbers 301 which are painted onto the shaft. Obviously, any number or combination of numbers could be used. Also, any number or combination of letters could be used. While the location of the numbers, letters, or the like would show the original orientation of the shaft relative to the die, the combination of numbers or letters could identify the actual die that was used to prepare the shaft. Also, when this type of marking or indication is used, the combination of numbers or letters could easily be changed every time the composition of raw material is changed.

Figure 6:
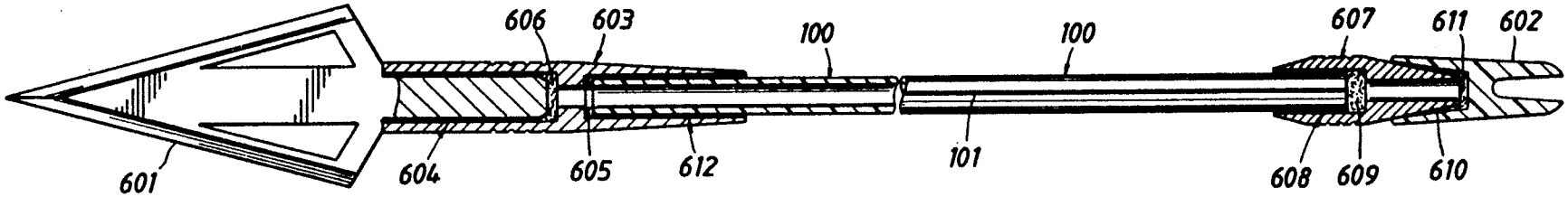
FIG. 6 is a partially cross sectioned side view of an arrow having a broad head arrow point and a nock attached thereto.

In FIG. 6, there is illustrated an arrow shaft 100 which has the original orientation of the shaft relative to the die marked or indicated with string or thread 101 having a broadhead arrow point 601 and a nock 602 attached thereto. The finished arrow comprises a point adapter 603 which is an integral, one-piece unit and includes two hollow, cylindrical bore portions 604 and 612. The point adapter 603 is glued to the arrow shaft at 605 and the point is glued to the point adapter at 606. Essentially any glue could be use to secure both the point adapter and the broadhead arrow point such as an epoxy glue. Frequently, however, a weaker glue will be used to secure the point adapter to the arrow shaft so that in the event of damage the point adapter could be removed and replaced without having to replace the entire structure. The arrow illustrated in FIG. 6 also comprises a nock cap 607. The nock cap includes a hollow cylindrical end 608 to facilitate attachment thereof to the arrow shaft. In the embodiment illustrated, the nock cap is glued to the arrow shaft at 609. The nock 602 also includes a hollow cylindrical end 610 to facilitate attachment thereof to the nock cap. In the embodiment illustrated, the nock 602 is glued to the nock cap at 611. It will, of course, be appreciated that gluing both the point and the nock to the arrow shaft facilitates lining both the point and the nock onto the shaft relative to the original orientation of the shaft through the die. This will, of course, produce a much truer arrow than has heretofore been possible.

Figure 7:
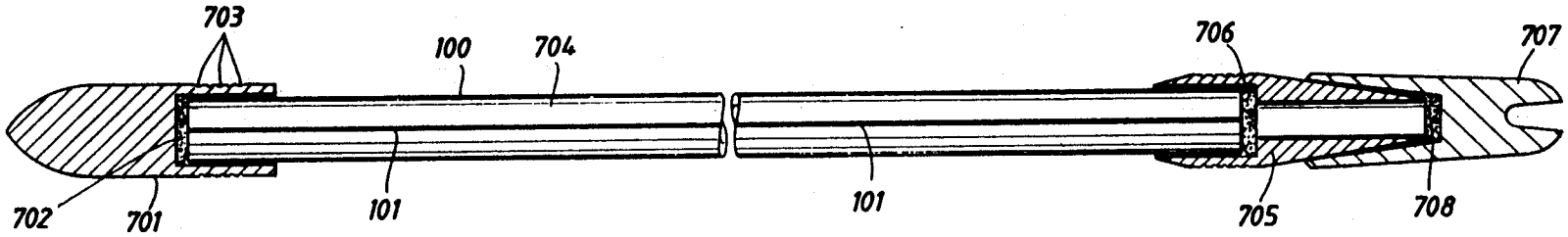
FIG. 7 is a side view of an arrow having a field point/target point and a nock attached thereto.

In FIG. 7, there is illustrated an arrow similar to that shown in FIG. 6 except that a field point is installed directly onto the shaft such that a point adapter is not used. Referring, then, to FIG. 7 the shaft 100 is again marked with string or thread 101. As just indicated, a field point 701 is attached directly to the shaft 100 by gluing at 702. Again, any type of glue such as an epoxy glue could be used but, frequently, a weaker glue would be preferable such that the field point 701 could be replaced if damaged without having to replace the entire arrow structure. It will, of course, be appreciated that the field point does not require the same close alignment in preparing the arrow that a broadhead point would require. In the embodiment illustrated, the point cap 701 may include identification grooves 703 for identifying varying configurations of the point cap as may be used with varying sizes and configurations of arrow points, shafts, etc. In the embodiment illustrated, the arrow shaft is hollow and comprises a bore 704. The arrow structure also comprises a nock cap 705 which is glued directly to the shaft at 706. Finally, the arrow as illustrated comprises a nock 707 which is glued to the nock cap at 708.

Figure 8:
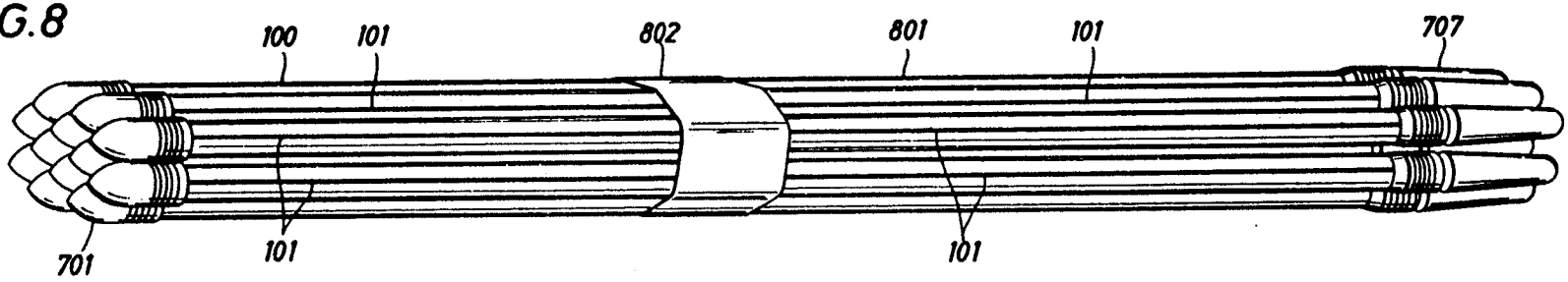
FIG. 8 is a side view of a bundle of pre-grouped arrows.

As indicated supra, the arrows with the mark may be grouped into sets of any number and these sets will constitute pre-grouped sets which should hit a target when shot in the same manner from a bow at substantially the same place. While the arrows may be pregrouped into sets of any number, 12 is most desirable since this seems to be the number of arrows that an archer seeks to establish a grouped set. A bundle of pre-grouped arrows having field points is illustrated in FIG. 8. The arrow included in the pre-grouped set is identical to the arrow described and illustrated in FIG. 7 and for that reason the arrows illustrated in the bundle have identifying numbers identical to those illustrated in FIG. 7. As can be seen in FIG. 8, the pre-grouped set comprises 12 arrows 801 and the set is bundled with a suitable colored bundling material 802. A band has been illustrated in the Figure but it will be appreciated that other materials such as rope and wire could be used. The color of the bundling material is an effective way to identify the time at which the arrows were manufactured and hence, the composition of the raw materials used to manufacture the same. To use the color in this manner, however, it will be necessary to change the color each time the supply of raw material is changed.

It will, of course, be appreciated that marking of arrows and bundling as heretofore described should enhance an archer's chance of finding a group of arrows which will hit a target when shot from a bow in essentially the same manner at substantially the same place. Normally, the archer would be happy with 12 such arrows and a pre-grouped package of 12 should satisfy this requirement. If, however, an arrow should be damaged, the archer could look for markings that would identify an arrow which has the same original orientation of the arrow shaft relative to the die and which was prepared from the same raw materials. As previously indicated, indication re raw materials can be accomplished by changing the marking of the original orientation but most conveniently will be accomplished by controlling the color of the bundling material used to pre-group the arrows in bundles.

Figure 9:
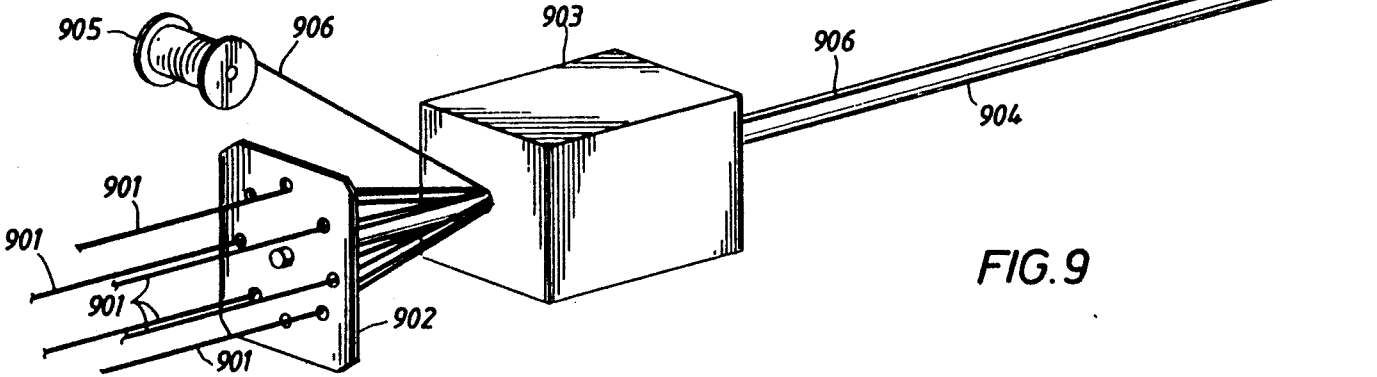
FIG. 9 is a schematic diagram of a process for preparing shafts within the scope of this invention.

In FIG. 9, a process for preparing an arrow shaft within the scope of the present invention is illustrated. Referring, then, to FIG. 9 a plurality of continuous fibers 901—901 pass through a fiber guide plate 902 then into a heated pultrusion die 903. A finished shaft 904 is pulled out of the pultrusion die 903. In the embodiment illustrated, a spool of constant colored thread 905 is continuously pulled through the die 903 such that a continuous thread 906—906 is visible, partly on the top side of the shaft. The continuous fibers 901 may be an of the fibers heretofore identified. A geometric figure or a continuous line could be painted onto the finished shaft 904 in an obvious fashion. Obviously, the continuous thread could be positioned at any location around the shaft as could a painted geometric figure or a continuous line.

PREFERRED EMBODIMENT

In a preferred embodiment of the present invention, string or thread will be used to mark the original orientation of the shaft through the die with which it is prepared. The shaft will be prepared with the well known pultrusion process. In the preferred embodiment, the pre-grouped arrows will be packaged in bundles.

While the present invention has been described and illustrated by reference to particular embodiments thereof, it will be appreciated by those of ordinary skill in the art that the same lends itself to variations not necessarily described or illustrated herein. For this reason, then, reference should be made solely to the appended claims for purposes of determining the true scope of the present invention.

Having thus described and illustrated the present invention, what is claimed is:

1. An arrow shaft comprising a mark or other indicia thereon; which shows the original orientation of the shaft relative to the die through which it was produced.

2. The arrow shaft of claim 1 wherein the mark or indicia is a continuous thread or string.

3. The arrow shaft of claim 1 wherein the mark or indicia is a geometric figure.

4. The arrow shaft of claim 3 wherein the geometric figure is painted.

5. The arrow of claim 1 wherein the marking is a continuous painted line.

6. The arrow shaft of claim 1 wherein the die is a pultrusion die.

7. A process for marking or otherwise indicating the original orientation of an arrow shaft relative to a pultrusion die comprising:

passing a plurality of continuous fibers into a die;
pulling a finished shaft from the die; and
marking the original orientation of the shaft relative to the pultrusion die.

8. The process of claim 7 wherein the marking or other indication is accomplished with a continuous string or thread.

9. The process of claim 7 wherein the marking or other indication is accomplished with a geometric figure.

10. The process of claim 9 wherein the geometric figure is painted.

11. The process of claim 7 wherein the mark is a continuous painted line.

12. An arrow comprising a shaft having its original orientation through a die in which it was prepared marked or otherwise indicated.

13. The arrow of claim 12 wherein the shaft is marked with a continuous thread or string.

14. The arrow of claim 12 wherein the shaft is marked with a geometric figure.

15. The arrow of claim 14 wherein the geometric figure is painted.

16. The arrow of claim 12 wherein the shaft is marked with a painted line.

17. The arrow of claim 12 further comprising a broadhead point.

18. The arrow of claim 12 further comprising a field point.

* * * * *